United States Patent [19]

Marshall

[11] Patent Number: 4,800,117

[45] Date of Patent: Jan. 24, 1989

[54] OVERFINISH FOR ZERO TWIST FABRIC

[75] Inventor: Robert M. Marshall, Chester, Va.

[73] Assignee: Allied-Signal Inc., Morris Township, Morris Co., N.J.

[21] Appl. No.: 864,350

[22] Filed: May 19, 1986

[51] Int. Cl.[4] ..... B32B 7/00; D03D 3/00

[52] U.S. Cl. ..... 428/260; 428/265; 428/267; 428/288; 428/290; 428/375; 428/378; 428/395; 57/232; 57/250; 57/258; 252/8.8; 8/115.6

[58] Field of Search ..... 428/265, 267, 260, 375, 428/378, 395; 8/115.6; 57/250, 232, 258

[56] References Cited

U.S. PATENT DOCUMENTS 4,389,456 6/1983 Marshall ..... 428/375

OTHER PUBLICATIONS

"REPEL-O-TEX HM" Product Bulletin, Lyndal Chemical, Division Millmaster Onyx Group, Kewanee Industries, Inc.

*Primary Examiner*—Sharon A. Gibson
*Attorney, Agent, or Firm*—William H. Thrower

[57] ABSTRACT

A fiber finish composition for synthetic multifilament yarn comprising effective amounts of an amide melamine wax applied to the yarn in an amount of 0.1 to 0.5 weight percent of the wax solids on the yarn provides yarn that can be woven into narrow fabric without twisting. When the applied finish composition is heated sufficiently, the resulting fabric woven from substantially untwisted yarn retains excellent resistance to abrasion properties. The amide melamine wax is formed by reacting melamine with a $C_6$ to $C_{36}$, preferably $C_{12}$ to $C_{22}$, fatty acid to form a hydrophobic amide, and polymerizing the amide with formaldehyde.

8 Claims, No Drawings

OVERFINISH FOR ZERO TWIST FABRIC

BACKGROUND OF THE INVENTION

The invention relates to improved multifilament synthetic yarns with improved abrasion resistance. More specifically, a novel aqueous overfinish composition applied to synthetic multifilament yarn provides a yarn which can be woven into narrow-woven fabrics without first twisting the yarn. When heated sufficiently, the resulting fabric retains required resistance to abrasion.

Narrow-woven fabrics are considered to be those fabrics manufactured to less than 12 inches in width and having woven or fastened-in selvages. Such fabrics are commonly woven on special narrow fabric looms or on needle looms that fabricate a number of tapes at the same time. End uses for narrow fabrics include automotive and aircraft seat belts, as well as many other applications including parachute harnesses, cargo slings, furniture tapes, elastic tapes, aircraft arrestor tapes and animal control webbings such as horse halters and dog collars.

Synthetic yarns including polyester and nylon yarns are used in these applications. Important property requirements for such applications include low elongation properties, excellent strength, good mechanical qualities such as abrasion resistance, good dyeing characteristics, and good light stability. The yarn must possess good weaving characteristics so that acceptable fabric is woven without undue picks from broken filaments.

Fiber finishes can be applied to the yarn to provide such necessary weaving characteristics, including necessary control of static, friction, and cohesiveness of filaments required for the weaving process. Additionally, the multifilament yarn is usually subjected to a twisting operation prior to weaving to provide enhanced weaving characteristics and to provide necessary resistance to abrasion for the finished fabric.

Applicant has discovered that by applying a novel fiber finish to the surface of the synthetic yarn, preferably after drawing, such yarn can be woven into a narrow fabric without twisting the yarn, thus providing an important cost savings benefit, and the resulting fabric still possesses required resistance to abrasion.

SUMMARY OF THE INVENTION

A fiber finish composition for synthetic multifilament yarn comprising effective amounts of an amide melamine wax applied to the yarn in an amount of 0.1 to 0.5 weight percent of the wax solids on the yarn provides yarn that can be woven into narrow fabric without twisting. When the applied finish composition is heated sufficiently, the resulting fabric woven from substantially untwisted yarn retains excellent resistance to abrasion properties. The amide melamine wax is formed by reacting melamine with a $C_6$ to $C_{36}$, preferably $C_{12}$ to $C_{22}$, fatty acid to form a hydrophobic amide, polymerizing the amide with formaldehyde, then emulsifying the resulting resin. The emulsion is incorporated into a compatible aqueous fiber finish chosen to provide good weaving characteristics for the yarn.

DESCRIPTION OF THE PREFERRED EMBODIMENT

Effective amounts of an amide melamine wax in a compatible fiber finish composition applied to synthetic multifilament yarn provides a yarn which can be woven into narrow fabric without twisting the yarn. When heated sufficiently, the resulting fabric offers abrasion resistance equivalent to fabric woven from twisted yarn.

The amide melamine wax is formed by reacting melamine with a $C_6$ to $C_{36}$, preferably $C_{12}$ to $C_{22}$, fatty acid to form a hydrophobic amide. The amide is reacted with formaldehyde and the resulting resin is emulsified. An example of a commercially available amide melamine wax suitable for this invention is Repel-O-Tex TM 100, available from Lyndal Chemical.

The amide melamine wax is incorporated as an emulsion into a compatible aqueous fiber finish composition and applied to the yarn in any of the conventional manners, preferably as an overfinish subsequent to drawing.

The aqueous fiber finish composition can be any compatible finish chosen to provide good weaving characteristics for the particular synthetic fiber to be treated. Examples of synthetic fiber include polyester and polyamide multifilament yarn. An example of a suitable finish composition for polyester fiber is that disclosed in U.S. Patent 4 389 456 to Marshall, hereby incorporated by reference. The oil-in-water yarn finish disclosed therein is an emulsion of water and about 15 to 40 weight percent of a nonaqueous portion comprising about 55 to 60 weight percent of a lubricant comprising transesterified lauric oil and oleic oil, the lauric oil containing at least about 40 percent lauric groups and the oleic oil containing at least about 60 percent oleic groups; about 15 to 28 weight percent of polyoxyalkylene castor oil; about 4 to 15 weight percent selected from the group consisting of triglycerol monooleate, triglycerol dioleate and mixtures thereof; about 7 to 12 weight percent selected from the group consisting of decaglycerol tetraoleate, decaglycerol pentaoleate and mixtures thereof; about 1 to 5 weight percent of a suitable antioxidant; and about 0.25 to 10 weight percent of an emulsion stabilizer selected from the group consisting of a salt of dialkyl sulfosuccinate neat wherein each alkyl group comprises 8 to 18 carbon atoms, a salt of dialkyl sulfosuccinate in solution or mixture wherein each alkyl group comprises 9 to 18 carbon atoms, and a mixture of a salt of dioctyl sulfosuccinate and a salt of an aromatic carboxylic acid.

A sufficient amount of the amide wax melamine emulsion is blended with a compatible overfinish and the blended overfinish is applied to yarn in an amount to provide from 0.1 to 0.5 weight percent of wax solids on the yarn. For example an overfinish with 10 weight percent wax solids is applied to yarn at an amount of 2 weight percent finish, based on the weight of the fiber. This results in 0.2 weight percent wax solids on the yarn, within the acceptable range. Insufficient wax solids will not yield acceptable abrasion resistance for zero-twist woven fabric, discussed below.

After applying the wax solids, an essential step is heating to promote cross-linking of the amide melamine wax. This provides the permanent coating on the fiber that enhances the abrasion resistance for the finished zero-twist woven fabric. Sufficient cross-linking is obtained by heating the treated fiber to a temperature as low as 120° C. for a period of about 3 minutes. Of course, higher temperatures will be effective for shorter time periods. The heating step can be accomplished at the time of coating the yarn or at a later time, for example coincident with dyeing the woven fabric.

An important application of the present invention is in the production of belting for passenger restraint systems for passenger vehicles.

Seat belting is generally woven in a two-up, 2-down herringbone twill. This weave helps to provide a relatively thin, narrow fabric having low elongation, high strength and good abrasion resistance. The dyeing and finishing process are an important part of seat belt production since the final belting must be resistance to fading by exposure to sunlight and the dyestuff must not fade or rub off even when the seat belt is wet. Seat belts are typically dyed with disperse dyestuffs in a continuous process which requires the use of heat. The heat utilized in the dyeing process to fix the dye into the fiber is also sufficient to cross-link the amide melamine wax coincident with dyeing. Thus an efficient, process for the production of narrow woven fabric is made possible wherein the substantially untwisted yarn can be woven directly into a narrow woven, zero-twist fabric and the final fabric heat treated to provide the resistance to abrasion essential for this application.

EXAMPLE

Finish Compound A is prepared as an aqueous emulsion with 67 weight percent water, 33 weight percent nonaqueous components which consist of:

| | Weight Percent |
|---|---|
| Rearranged coconut glyceride | 57 |
| decaglycerol tetraoleate | 8.5 |
| triglycerol monooleate | 5.5 |
| polyoxyethylene (25) castor oil | 25 |
| dinonylsulfosuccinate | 1 |
| 4,4'butylidene bis(6-tert-butyl-a-cresol) | 3 |
| | 100.0 |

Finish compound B is prepared by combining 3 parts by weight of finish compound A with 2 parts by weight Repel-O-Tex TM 100, available from Lyndal Chemical, an emulsion containing 25 weight percent amide melamine wax. Thus finish compound B comprises 10 weight percent wax solids.

For this example 840 denier 70 filament polyethylene terephthalate yarn commercially available from Allied Corporation as Type 1W70 polyester was utilized.

Finish compound A was applied to the polyester yarn at a 0.6 weight percent nonaqueous add-on to provide the control yarn.

Finish compound B was applied to the polyester yarn at a nonaqueous add-on of 0.6 weight percent, consisting of 0.2 weight percent wax and 0.4 weight percent of the nonaqueous components described above for finish compound A.

Seat belt webbing was prepared from each of the above two yarns by two procedures:

1. By the standard technique, the yarns are two plied and twisted together at 2.5 turns per inch to form cord. A seat belt is woven with 264 cords in the warp direction and 17 picks per inch for filling.
2. Zero twist technique, 528 ends were fed directly into the loom without twisting and woven to a similar weight count.

The resulting belts were then dyed with disperse dyestuffs in a continuous thermosol/hot air process, which includes the step of passing dried webbing through a thermosol oven for about two minutes at 190° to 220° C.

The dyed belting was tested for web abrasion by dragging a portion of belt through a seat belt buckle 5000 times (2500 cycles). The test was repeated six times for each of the four samples. Breaking strength of the abraded belts was compared with breaking strength of the original unabraded belt. Results are reported in percent breaking strength retained.

| | Standard Belt (Twisted), % | Zero Twist Belt, % |
|---|---|---|
| Control - Finish A | 88 | 51.7 |
| Yarn with Finish B | 89 | 87.5 |

Thus it can be seen with the cured coating of amide melamine wax on the yarn, the zero twist fabric retains the abrasion resistance of the control yarn which has been twisted.

What is claimed:

1. Synthetic multifilament yarn having deposited thereon a finishing composition comprising 0.1 to 0.5 weight percent, based on weight of the yarn, amide melamine wax formed by reacting melamine with a $C_6$ to $C_{36}$ fatty acid, then reacting the resulting product with formaldehyde and heating the yarn to sufficiently crosslink said wax.

2. The yarn of claim 1 selected from the group consisting of polyester and polyamide.

3. The yarn of claim 1 wherein said fatty acid is a $C_{12}$ to $C_{22}$ fatty acid.

4. The yarn of claim 1, which has been heated to a temperature of at least 120° C. for a period of time sufficient to crosslink said wax.

5. The yarn of claim 4 selected from the group consisting of polyester and polyamide.

6. Fabric woven from the yarn of claim 1.

7. The fabric of claim 6 which has been woven from substantially untwisted yarn.

8. The fabric of claim 7 wherein the yarn is selected from the group consisting of polyester and polyamide.

* * * * *